United States Patent [19]

Nakano et al.

[11] Patent Number: 4,849,725

[45] Date of Patent: Jul. 18, 1989

[54] MULTIPOLAR CIRCUIT BREAKER

[75] Inventors: Shozo Nakano, Kumigaya; Hideo Hayashi, Saitama, both of Japan

[73] Assignee: Fuji Electric Co., Ltd., Kawasaki, Japan

[21] Appl. No.: 199,194

[22] Filed: May 26, 1988

[30] Foreign Application Priority Data

Jun. 12, 1987 [JP] Japan ..... 60-90329[U]

[51] Int. Cl.[4] ..... H01H 75/00

[52] U.S. Cl. ..... 335/8; 200/293

[58] Field of Search ..... 335/6, 8–10, 335/35, 131, 132, 202; 200/293, 295, 303

[56] References Cited

U.S. PATENT DOCUMENTS

| | | | |
|---|---|---|---|
| 3,483,341 | 9/1976 | Stanish | 200/303 |
| 3,536,872 | 10/1970 | Gilardenghi | 200/295 |
| 3,560,901 | 2/1971 | Shizuka Horii et al. | 200/295 |
| 4,286,130 | 8/1981 | Troebel | 200/303 |
| 4,434,339 | 2/1984 | Ohashi | 200/295 |

*Primary Examiner*—E. A. Goldberg
*Assistant Examiner*—Lincoln Donovan
*Attorney, Agent, or Firm*—Bruce L. Birchard

[57] ABSTRACT

A multipolar circuit breaker having a lower case portion with side frame plates and a central frame plate facing the side frame plates on its two major sides, the central frame plate having a deep central groove which forms two flexible central frame plate arms each facing one of the side frame plates to form a nacelle sized to receive one of the switching mechanisms, each of the side frame plates and the arms of the central frame plate having, proximate to its free end, at-least-one inwardly facing protrusion, each of which is in a position opposed to the corresponding protrusion on the companion plate forming the nacelle and, after the respective switching mechanisms are installed, overlapping the side plates of each of the switching mechanisms, the arms of the central frame plate having been deflected to permit insertion of each switching mechanism, deflection in testing or use being prevented by inserting a high dielectric strength plastic stiffener in the groove separating the arms in the central frame plate, the lower case side frame plates having on their outer surfaces near the base of the lower case portion at-least-one retainer protrusion which cooperates with properly positioned openings in the upper case portion when that portion is in position covering the sides and top of the lower case portion to hold the upper case portion removably in that position, as a result of all of which the switching mechanisms may be checked for defects during production without assembling and then disassembling the circuit breaker.

10 Claims, 3 Drawing Sheets

MULTIPOLAR CIRCUIT BREAKER

BACKGROUND OF THE INVENTION

1. Field of the Invention

This invention relates to electrical circuit breakers and, more specifically, to multipolar circuit breakers.

2. Prior Art

Multipolar circuit breakers prior to this invention could not be tested for quality control purposes during manufacture until the fabrication of each breaker was completed. At that point it was too late to do corrective work without expensive and time-consuming modification of the defective product. It has been usually cheaper to dispose of the defective product.

Even with two-piece housings such was the case, because the support for the switching mechanism required the upper and lower portions of the housing to be joined before the switching element of the breaker could be tested.

Therefore, it is an object of this invention to overcome the general disadvantages of prior art multipolar circuit breakers.

It is a further object of the present invention to provide a circuit breaker which can be tested for quality control purposes during manufacture and before the breaker is completely assembled.

SUMMARY OF THE INVENTION

There is provided, according to this invention, a multipolar circuit breaker with a case having an upper portion and a lower portion, the material of the case, particularly the lower portion thereof, being a resilient, electrically-insulating material, for example, a molded, synthetic resin material. The lower case-portion has integral outer frame plates, a central frame plate and a base common to all of the plates. The central frame plate has a groove therein for receiving a stiffener member, but, prior to receiving that stiffener member, the wall portions of the central frame plate formed by the groove are sufficiently flexible to permit flexing a distance adequate to permit the insertion of the complete switching element for each pole of the breaker. Each of the switching elements, supported in its own side plates, is retained in proper operating position by inwardly extending protrusions at the upper extremities of the frame plates of the lower case section. The protrusions at the upper ends of the central, bifurcated frame plate snap back from their deflected positions, as the respective switching elements are being inserted, to a retaining position in which they overlap the side plates of the respective switching elements. When the stiffener element is inserted, the central frame plate becomes rigid and the switching elements are locked in position. They may then be tested, individually, and, if there is any defect in their operation, the stiffener may be removed, the appropriate wall portion of the central frame can be deflected and the defective switching element removed for repair or replacement.

BRIEF DESCRIPTION OF THE DRAWINGS

This invention and its operation can best be understood by taking the description which follows in conjunction with the drawings herein, in which.

DETAILED DESCRIPTION OF THE PREFERRED EMBODIMENT

Figure 1:
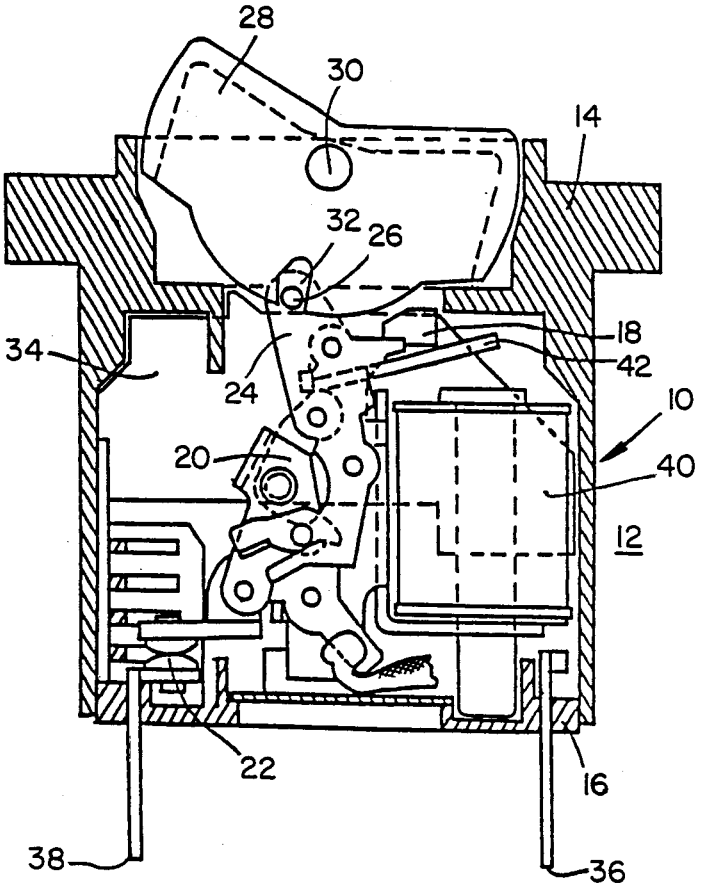
FIG. 1 is a longitudinal, cross-sectional view of a multipolar circuit breaker according to the present invention.

In FIG. 1 circuit breaker 10 includes case 12 having upper portion 14 and lower portion 16. Case 12 is usually injection molded from a synthetic resin. The synthetic resin should produce a plastic case 12 which has high impact resistance and good electrical insulation properties, i.e., a high dielectric strength. These materials are, of course, widely available. A switching mechanism or element 20 is supported from its side plates 18 within case 12, as can be seen more clearly in FIG. 2. Each switching element 20 has a contact unit 22 associated therewith which performs the ultimate task of opening and closing the external circuit being controlled by circuit breaker 10. Each switching element 20 also has an actuating lever 24. The actuating elements 24 of successive poles of the circuit breaker 10 are intercoupled by actuating shaft 26, as can be seen more clearly in FIG. 2.

Arcuately displaceble reset button 28 is supported on shaft elements 30 and has a fork-lever slot which is positioned and shaped to engage actuating shaft 26 for the resetting of circuit breaker 10.

The poles in the multipolar circuit breaker 10 are separated by a central frame plate 34.

The current into and out of circuit breaker 10 flows through connectors 36 and 38.

Circuit breaker solenoid 40 acts in the conventional fashion upon actuating lever 42 to cause the opening of contacts 22 when current is excessive in the circuits which circuit breaker 10 is supposed to control.

Figure 2:
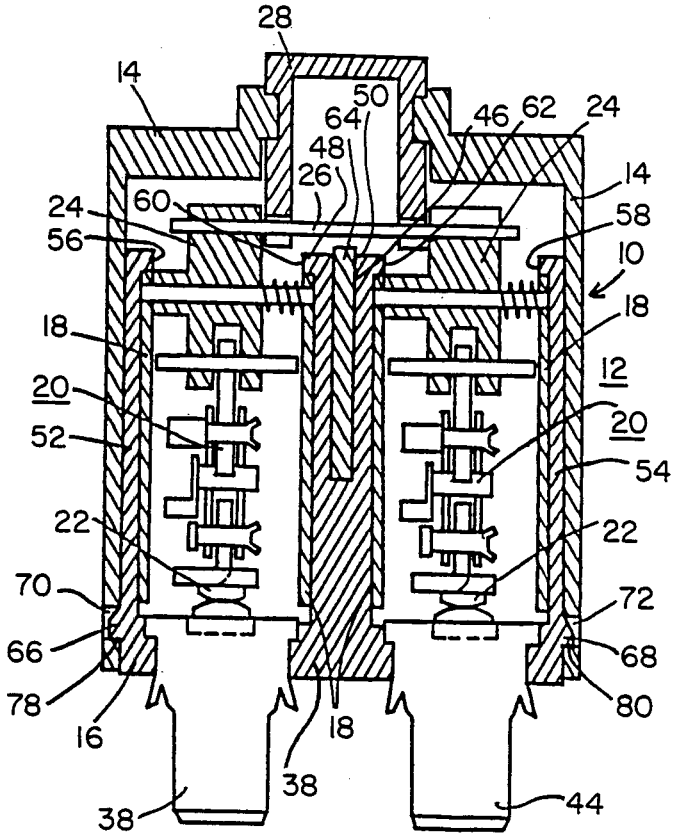
FIG. 2 is a transverse sectional view of the current breaker of FIG. 1.

Turning to FIG. 2, similar elements have been given similar numbers to those applied in connection with the description of FIG. 1. Further, in FIG. 2, the novel fashion in which switching elements 20 are held in position so as to permit testing in the course of production is shown.

As can be seen from FIG. 2, switching mechanisms 20 each have a pair of side plates 18. Lower case portion 16, the major elements of which may be seen more clearly in FIG. 4, has a central member 34 which, in its upper region, has a centrally located, deeply cut groove 46, forming two flexible frame-plate arms 48, 50. Lower case 16 also includes side frame plates 52 and 54. At the upper end of side frame plate 52 is an inwardly-directed protrusion or projection 56. At the upper end of side frame plate 54 is an inwardly-directed protrusion or projection 58.

At the upper end of frame plate arm 48 is a protrusion or projection 60 which faces protrusion 56 on frame plate 52. At the upper end of frame plate arm 50 is a protrusion or projection 62 which faces protrusion 58 on frame plate arm 54.

As has been indicated, the plastic material making up lower case 16 and, hence, central frame plate 34 is resilient, making frame plate arms 48 and 50 as well as side frame plates 52 and 54 deflectable without breaking or permanent displacement. Thus, switching mechanisms 20 may be inserted in lower case 16 when the side frame plates 52 and 54 and the central frame-plate arms 48 and 50 are deflected. When those side frame plates and central frame-plate arms are released, protrusions 56, 60 engage and lock in position the side plates of the associated switching mechanisms 20. Similarly, protrusions 58, 62 overlap and lock in position the side plates 18 which are part of their associated switching mechanisms 20. The side plates being integral with their associated switching mechanisms, the switching mechanisms are locked in position and may be tested as, for example, by operating switching levers 24. To further assure the accurate positioning of switching mechanisms 20, stiffener 64 is inserted in groove 46. It is of a high dielectric strength plastic with mechanical rigidity so as to increase the insulation between the poles of adjacent circuit breakers and, at the same time, fix the mechanical positioning of the switching mechanisms 20.

If either or any one of the switching mechanisms 20 does not pass the quality control tests, the insertion procedure just described may be reversed and the defective switching unit 20 removed for repair or replacement.

After the switching mechanisms 20 have been successfully tested the remaining step is to apply upper case portion 14. As can be seen from FIGS. 2, 3 and 4, side frame plates 52 and 54 have locking projections 66 and 68, respectively, thereon. Upper case portion 14 has cooperating openings 70 and 72 near the lower edge thereof. The positioning of openings 70 and 72 is such as to hold upper case portion 14 on lower case portion 16 with switching fork lever 32 of reset button 28 in engagement with actuating shaft 26.

It is to be noted that projections or protrusions 66, 68 are tapered in the direction of application of upper case 14 so as to guide side walls 74 and 76 of upper case portion 14 over projections 66, 68 until projections 66, 68 snap into openings 70, 72. When that occurs, shoulders 78 and 80 of projections 66 and 68, respectively, engage the contiguous wall of openings 70 and 72, respectively, and upper case portion 14 cannot be slid upwardly, (as presented in FIG. 2), without distortion of upper case portion 14 until shoulders 78 and 80 are clear of their respective contiguous walls of openings 70 and 72. Thus, upper case portion 14 is held in place.

Figure 3:
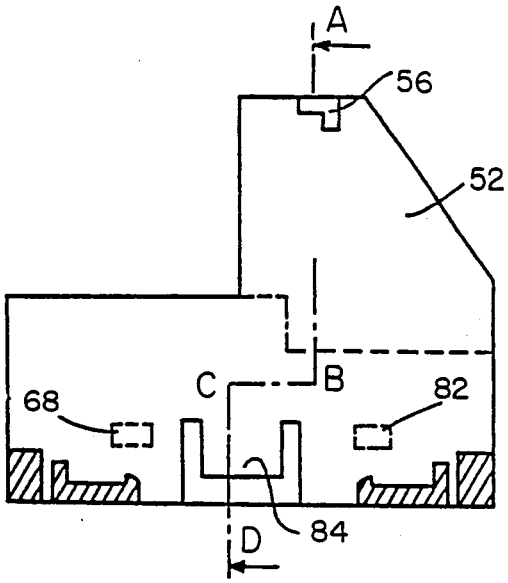
FIG. 3 is a partially sectioned view of a portion of the device of FIGS. 1 and 2; and, FIG. 4 is a sectional view taken along the line A—B—C—D in FIG. 3.
Figure 4:
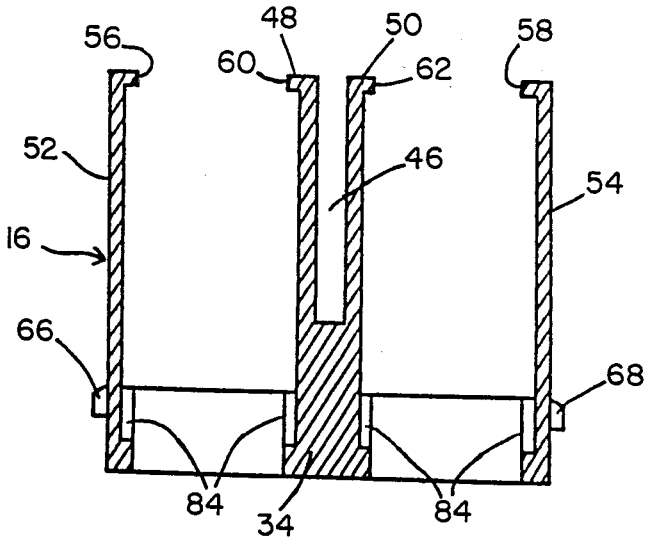

Lateral location of switching mechanisms 20 is achieved by lower receptacles 84 appearing in FIGS. 3 and 4. The second protrusion 82 on side frame plate 52 does not appear in FIG. 4 but works in the same fashion as protrusion 68 to retain upper case portion 14 in position.

While a particular embodiment has been shown and described, it will be apparent to those skilled in the art that variations and modifications may be made therein without departing from the true spirit and scope of this invention.

What is claimed is:

1. An improved multipolar circuit breaker, including:

a plastic lower case portion having a pair of side frame plates and a central frame plate intercoupled by a base portion, said central frame plate having a groove therein whereby a pair of flexible frame plate arms is formed each with an inner surface;

said side frame plates each carrying at its respective end remote from said base an inwardly directed protrusion;

each of said frame plate arms carrying at its end remote from said base portion a protrusion positioned in opposition to a respective one of said protrusions on said side frame plates, each of said side frame plates being spaced from the inner surface of its opposing central frame plate arm a first distance which is greater than the distance between protrusions on each side frame plate and its opposing central frame plate arm;

multiple switching mechanisms each having a pair of side plates with outer surfaces spaced by a distance approximating said first distance;

said multiple switching mechanisms, when inserted in the space between respective combinations of a side frame plate and an opposed central frame plate arm having its side plates overlapped by opposed ones of said protrusions;

a stiffener removably carried in said groove and sized and shaped to produce an interference fit with the walls of said groove; and, an upper case portion, including a reset button, removably covering selected sides of said lower case portion.

2. Apparatus according to claim 1 in which each of said side frame plates carries on the external surface thereof, proximate to said base portion, at-least-one retainer protrusion and said upper case portion has openings therein sized and positioned to be engaged by said at-least-one retainer protrusion.

3. Apparatus according to claim 1 which includes, in addition, an actuating shaft intercoupling said multiple switching mechanisms.

4. Apparatus according to claim 1 which includes, in addition, an actuating shaft intercoupling said multiple switching mechanisms said actuating shaft being operatively engaged by a portion of said reset button.

5. Apparatus according to claim 2 in which said at-least-one retainer protrusion is beveled.

6. Apparatus according to claim 1 in which said stiffener is a plastic stiffener with high dielectric strength.

7. Apparatus according to claim 1 in which said lower case portion and said upper case portion are of identical resin-based plastic materials.

8. Apparatus according to claim 1 in which said multiple switching mechanisms have respective actuating arms intercoupled by an actuating shaft.

9. Apparatus according to claim 7 in which said resin-based plastics are flexible.

10. Apparatus according to claim 1 in which said upper case portion includes cylindrical plastic shaft elements for supporting said reset button for arcuate movement.

* * * * *